US008010374B2

(12) United States Patent
Shimizu et al.

(10) Patent No.: US 8,010,374 B2
(45) Date of Patent: Aug. 30, 2011

(54) AUDIO CODING APPARATUS AND AUDIO DECODING APPARATUS

(75) Inventors: Takashi Shimizu, Osaka (JP); Takatoshi Nishio, Osaka (JP)

(73) Assignee: Panasonic Corporation, Osaka (JP)

( * ) Notice: Subject to any disclaimer, the term of this patent is extended or adjusted under 35 U.S.C. 154(b) by 737 days.

(21) Appl. No.: 12/142,458

(22) Filed: Jun. 19, 2008

(65) Prior Publication Data

US 2008/0319563 A1 Dec. 25, 2008

(30) Foreign Application Priority Data

Jun. 22, 2007 (JP) ..... 2007-164582

(51) Int. Cl.
*G10L 21/04* (2006.01)

(52) U.S. Cl. ..... 704/503; 704/500; 704/229

(58) Field of Classification Search ..... 704/229, 704/230, 503, 500, 501, 200.1; 341/50
See application file for complete search history.

(56) References Cited

U.S. PATENT DOCUMENTS

| | | | | |
|---|---|---|---|---|
| 6,295,009 | B1 * | 9/2001 | Goto | 341/50 |
| 6,697,775 | B2 * | 2/2004 | Kawahara | 704/229 |
| 2003/0144755 | A1 | 7/2003 | Naruki et al. | |

FOREIGN PATENT DOCUMENTS

| | | |
|---|---|---|
| JP | 2004-205679 | 7/2004 |
| JP | 2006-114148 | 4/2006 |

* cited by examiner

*Primary Examiner* — Huyen X. Vo
(74) *Attorney, Agent, or Firm* — Wenderoth, Lind & Ponack, L.L.P.

(57) ABSTRACT

An audio coding apparatus includes an audio coding unit 101 for, when it has received an audio signal input, performing coding to the audio signal input and outputting coded audio data and coding related data which is data relating to the coding, as specific data, an ancillary audio coding unit 102 for, when it has received an ancillary audio signal, performing coding to the ancillary audio signal and outputting coded ancillary audio data, and an auxiliary data output unit 103 for producing, from the specific data and the coded auxiliary data, auxiliary data including both of the specific data and the coded ancillary audio data, and outputting the auxiliary data.

7 Claims, 10 Drawing Sheets

AUDIO CODING APPARATUS AND AUDIO DECODING APPARATUS

FIELD OF THE INVENTION

The present invention relates to an audio coding apparatus and an audio decoding apparatus, and more particularly, to an audio coding apparatus for performing digital signal processing and coding, and an audio decoding apparatus for reproducing coded data.

BACKGROUND OF THE INVENTION

There have conventionally been an audio coding apparatus and an audio decoding apparatus, which access a portion that is not music information to output music (e.g., refer to Japanese Published Patent Application No. 2006-114148).

FIG. 9 shows a format on a CD for recording an audio signal. FIG. 10 is a flowchart for explaining the operation of the conventional audio decoding apparatus.

Hereinafter, the operation of the conventional audio decoding apparatus will be described along the flowchart shown in FIG. 10 with reference to FIG. 9.

The conventional audio decoding apparatus reads data in a read IN area (900 in FIG. 9), and reads TOC information of the disk (step ST1).

Then, the audio decoding apparatus extracts control codes of the respective tracks from the read TOC information (step ST2), and judges whether the CD is a CD-DA audio disk or a CD-ROM disk (step ST3).

When the CD is a CD-DA audio disk, the audio decoding apparatus performs CD audio playback based on the TOC information (step ST12), and thereby performs music playback as an ordinary CD player.

On the other hand, when the CD is judged as a CD-ROM disk, the audio decoding apparatus reads the contents of a CD-ROM pass table (901 in FIG. 9), and thereby reads a file structure as a CD-ROM (step ST4).

The audio decoding apparatus confirms the read file structure, and judges whether a compressed audio file is present or not from such as a file extension (step ST5), and terminates the processing when no compressed audio file is present. Subsequently, the audio decoding apparatus confirms whether an information file (903 in FIG. 9) is present or not from such as the file extension (step ST6).

When no information file is present, the audio decoding apparatus performs extraction of the compressed audio file on the basis of the contents of the CD-ROM file system with reference to the pass table (901 in FIG. 9) (step ST10), and starts up a compressed audio playback program (step ST11) to perform playback of the compressed audio.

On the other hand, when an information file is present, the audio decoding apparatus reads the contents thereof (step ST7), and forms a music playback list (step ST8).

In addition, the audio decoding apparatus extracts the respective file names and playback start addresses (absolute addresses) from the playback list (step ST9).

The conventional audio coding apparatus performs coding based on the format shown in FIG. 9 so that the coded data are reproduced by the above-described audio decoding apparatus.

In the conventional audio coding apparatus, a music playback list is formed using the data other than the compressed audio data to give associations between titles and audio data, while in the audio decoding apparatus, coded audio data is decoded using these associations to reproduce audio.

However, since in such associations between titles and audio data in the audio coding apparatus, link with the compressed audio data is performed by only information such as playback start address, it was not possible to process the compressed audio data itself thereby to output various kinds of audio data.

SUMMARY OF THE INVENTION

The present invention is made to solve the above-described problems and has for its object to provide an audio coding apparatus and an audio decoding apparatus, which can realize playback of audio including desired ancillary superposed, at the decoding end.

Other objects and advantages of the invention will become apparent from the detailed description that follows. The detailed description and specific embodiments described are provided only for illustration since various additions and modifications within the scope of the invention will be apparent to those of skill in the art from the detailed description.

According to a first aspect of the present invention, there is provided an audio coding apparatus which outputs coded audio data comprising an audio signal input coded and auxiliary data which is information other than the coded audio data, according to a predetermined rule, which apparatus comprises: an audio coding unit which, when it has received an audio signal input, performs coding to the audio signal input and outputs the coded audio data and coding related data which is data relating to the coding for the audio data as specific data; an ancillary audio coding unit which, when it has received an ancillary audio signal, performs coding to the ancillary audio signal to output coded ancillary audio data; and an auxiliary data output unit which produces, from the specific data and the coded ancillary audio data, auxiliary data including both of the specific data and the ancillary audio data to output the auxiliary data.

Therefore, it is possible to obtain an audio coding apparatus which can output a stream comprising coded audio data and auxiliary data including coded ancillary audio data, and which can make an audio decoding apparatus output an audio signal synthesizing the audio data and the ancillary audio data.

According to a second aspect of the present invention, there is provided an audio coding apparatus which outputs coded audio data comprising an audio signal input coded and auxiliary data which is information other than the coded audio data, according to a predetermined rule, which apparatus comprises: an audio coding unit which, when it has received an audio signal input, performs coding to the audio signal input and outputs coded audio data and coding related data which is data relating to the coding for the audio data as specific data; an ancillary audio selecting/outputting unit which, with storing a plurality of ancillary audio data, selects one of the stored ancillary audio data according to an inputted selection signal, and outputs the selected data as coded ancillary audio data; and an auxiliary data output unit which produces, from the specific data and the coded ancillary audio data, auxiliary data including both of the specific data and the ancillary audio data to output the auxiliary data.

Therefore, it is possible to obtain an audio coding apparatus which can output a stream comprising coded audio data and auxiliary data including selected coded ancillary audio data, and which can make an audio decoding apparatus output an audio signal synthesizing the audio data and the ancillary audio data.

According to a third aspect of the present invention, there is provided an audio decoding apparatus which decodes the coded audio data and the auxiliary data which are outputted from the audio coding apparatus according to the first aspect, and synthesizes, from both the decoded data, an audio signal and outputs the same, which apparatus comprises: an ancillary audio extraction unit which extracts, from the auxiliary data, coded ancillary audio data to output the same; an ancillary audio decoding unit which decodes the coded ancillary audio data to output decoded ancillary audio data; an audio decoding unit which decodes the coded audio data to output decoded audio data; and an audio synthesis unit which synthesizes the audio data decoded by the audio decoding unit and the ancillary audio data decoded by the ancillary audio decoding unit to output a synthesis audio signal.

Therefore, it is possible to obtain an audio decoding apparatus which can decode a stream which is outputted from an audio coding apparatus, which stream includes coded audio data and auxiliary data including coded ancillary audio data, and which can output an audio signal synthesizing the audio data and the ancillary audio data.

According to a fourth aspect of the present invention, there is provided an audio decoding apparatus which decodes the coded audio data and the auxiliary data which are outputted from the audio coding apparatus according to the second aspect, and synthesizes, from both the decoded data, an audio signal and outputs the same, which apparatus comprises: an ancillary audio extraction unit which extracts, from the auxiliary data, coded ancillary audio data to output the same; an ancillary audio decoding unit which decodes the coded ancillary audio data to output decoded ancillary audio data; an audio decoding unit which decodes the coded audio data to output decoded audio data; and an audio synthesis unit which synthesizes the audio data decoded by the audio decoding unit and the ancillary audio data decoded by the ancillary audio decoding unit to output a synthesis audio signal.

Therefore, it is possible to obtain an audio decoding apparatus which can decode a stream outputted from an audio coding apparatus, which stream includes coded audio data and auxiliary data including coded ancillary audio data, and which can output an audio signal synthesizing the audio data and the ancillary audio data.

According to a fifth aspect of the present invention, there is provided an audio coding apparatus which outputs coded audio data comprising an audio signal input coded and auxiliary data which is information other than the coded audio data, according to a predetermined rule, which apparatus comprises: an audio coding unit which, when it has received an audio signal input, performs coding to the audio signal input and outputs coded audio data and coding related data which is data relating to the coding for the audio signal as specific data; and an auxiliary data output unit which, when it has received ancillary audio selection signal data for selecting ancillary audio, produces, from the ancillary audio selection signal data and the specific data outputted from the audio coding unit, auxiliary data to output the same.

Therefore, it is possible to obtain an audio coding apparatus which can output a stream comprising coded audio data and auxiliary data including ancillary audio selection data, and which can make an audio decoding apparatus output an audio signal synthesizing the audio data and the ancillary audio data.

According to a sixth aspect of the present invention, there is provided an audio decoding apparatus which decodes the coded audio data and the auxiliary data which are outputted from the audio coding apparatus according to the fifth aspect, and synthesizes, from both the decoded data, an audio signal and outputs the same, which apparatus comprises: an ancillary audio selection data/coding related data extraction unit which extracts, from the auxiliary data, the ancillary audio selection data and the coding related data as the specific data to output both of the extracted data; a coded ancillary audio data selecting/outputting unit which, when it has received the ancillary audio selection data, selects, from among stored 1st to Nth (N: integer not less than 2) coded ancillary audio data, desired coded ancillary audio data according to the inputted ancillary audio selection data; an ancillary audio decoding unit which decodes the selected coded ancillary audio data to output decoded ancillary audio data; an audio decoding unit which decodes the coded audio data to output decoded audio data; and an audio synthesis unit which synthesizes the decoded audio data and the decoded ancillary audio to output a synthesis audio signal.

Therefore, it is possible to obtain an audio decoding apparatus which can decode a stream outputted from an audio coding apparatus, which stream includes coded audio data and auxiliary data including ancillary audio selection data, and which can output an audio signal synthesizing the audio data and the ancillary audio data.

According to a seventh aspect of the present invention, there is provided an audio decoding apparatus which decodes the coded audio data and the auxiliary data which are outputted from the audio coding apparatus according to the fifth aspect, and synthesizes, from both the decoded data, an audio signal and outputs the same, which apparatus comprises: an ancillary audio selection data/coding related data extraction unit which extracts, from the auxiliary data, the ancillary audio selection data and the coding related data as the specific data, and outputs both of the extracted data; an ancillary audio selecting/outputting unit which, when it has received the ancillary audio selection data, selects, from among stored 1st to Nth (N: integer not less than 2) ancillary audio data, desired ancillary audio data according to the inputted ancillary audio selection data; an audio decoding unit which decodes the coded audio data to output decoded audio data; and an audio synthesis unit which synthesizes the decoded audio data and the selected ancillary audio data, and outputs a synthesis audio signal.

Therefore, it is possible to obtain an audio decoding apparatus which can decode a stream outputted from an audio coding apparatus, which stream includes coded audio data and auxiliary data including ancillary audio selection data, and which can output an audio signal synthesizing the audio data and the ancillary audio data.

EFFECTS OF THE INVENTION

According to a first aspect of the present invention, there is provided an audio coding apparatus which outputs coded audio data comprising audio input that is coded, and auxiliary data that is information other than the coded audio data, according to a predetermined rule, which apparatus comprises: a coding unit which, when it has received audio data, performs coding to the audio data and outputs the coded audio data and coding related data which is data relating to the coding for the audio data as specific data; an ancillary audio coding unit which, when it has received an ancillary audio signal, performs coding to the ancillary audio signal to output coded ancillary audio data; and an auxiliary data output unit which produces, from the specific data and the coded ancillary audio data, auxiliary data including both of the specific data and the coded ancillary audio data to output the auxiliary data. Therefore, it is possible to obtain an audio coding apparatus which can output a stream comprising coded audio data and auxiliary data including coded ancillary audio data, and which can make an audio decoding apparatus output an audio signal synthesizing the audio data and the ancillary audio data.

According to a second aspect of the present invention, there is provided an audio coding apparatus which outputs coded audio data comprising audio input that is coded, and auxiliary data that is information other than the coded audio data, according to a predetermined rule, which apparatus comprises: a coding unit which, when it has received audio data, performs coding to the audio data and outputs the coded audio data and coding related data which is data relating to the coding for the audio data as specific data; an ancillary audio selecting/outputting unit which, with storing a plurality of ancillary audio data, selects one of the stored ancillary audio data according to an inputted selection signal, and outputs the selected data as coded ancillary audio data; and an auxiliary data output unit which produces, from the specific data and the coded ancillary audio data, auxiliary data including both of the specific data and the coded ancillary audio data to output the auxiliary data. Therefore, it is possible to obtain an audio coding apparatus which can output a stream comprising coded audio data and auxiliary data including selected coded ancillary audio data, and which can make an audio decoding apparatus output an audio signal synthesizing the audio data and the ancillary audio data.

According to a third aspect of the present invention, there is provided an audio decoding apparatus which decodes the coded audio data and the auxiliary data which are outputted from the audio coding apparatus as defined in Claim 1, and synthesizes, from both of the decoded data, an audio signal and outputs the same, which apparatus comprises: an ancillary audio extraction unit which extracts, from the auxiliary data, coded ancillary audio data to output the same; an ancillary audio decoding unit which decodes the coded ancillary audio data to output decoded ancillary audio data; an audio decoding unit which decodes the coded audio data to output decoded audio data; and an audio synthesis unit which synthesizes the audio data decoded by the audio decoding unit and the ancillary audio data decoded by the ancillary audio decoding unit to output a synthesis audio. Therefore, it is possible to obtain an audio decoding apparatus which can decode a stream which is outputted from an audio coding apparatus, which stream includes coded audio data and auxiliary data including coded ancillary audio data, and which can output an audio signal synthesizing the audio data and the ancillary audio data.

According to a fourth aspect of the present invention, there is provided an audio decoding apparatus which decodes the coded audio data and the auxiliary data which are outputted from the audio coding apparatus as defined in Claim 2, and synthesizes, from both of the decoded data, an audio signal and outputs the same, which apparatus comprises: an ancillary audio extraction unit which extracts, from the auxiliary data, coded ancillary audio data to output the same; an ancillary audio decoding unit which decodes the coded ancillary audio data to output decoded ancillary audio data; a decoding unit which decodes the coded audio data to output decoded audio data; and an audio synthesis unit which synthesizes the audio data decoded by the audio decoding unit and the ancillary audio data decoded by the ancillary audio decoding unit to output a synthesis audio. Therefore, it is possible to obtain an audio decoding apparatus which can decode a stream outputted from an audio coding apparatus, which stream includes coded audio data and auxiliary data including coded ancillary audio data, and which can output an audio signal synthesizing the audio data and the ancillary audio data.

According to a fifth aspect of the present invention, there is provided an audio coding apparatus which outputs coded audio data comprising audio input that is data, and auxiliary data that is information other than the coded audio data, according to a predetermined rule, which apparatus comprises: a coding unit which, when it has received audio data, performs coding to the audio data and outputs the coded audio data and coding related data which is data relating to the coding for the audio signal as specific data; and an auxiliary data output unit which, when it has received ancillary audio selection signal data for selecting ancillary audio, produces, from the ancillary audio selection signal data and the specific data outputted from the audio coding unit, auxiliary data to output the same. Therefore, it is possible to obtain an audio coding apparatus which can output a stream comprising coded audio data and auxiliary data including ancillary audio selection data, and which can make an audio decoding apparatus output an audio signal synthesizing the audio data and the ancillary audio data.

According to a sixth aspect of the present invention, there is provided an audio decoding apparatus which decodes the coded audio data and the auxiliary data which are outputted from the audio coding apparatus as defined in Claim 5, and synthesizes, from both of the decoded data, an audio signal and outputs the same, which apparatus comprising: an ancillary audio selection data/coding related data extraction unit which extracts, from the auxiliary data, the ancillary audio selection data and the coding related data as the specific data to output both of the extracted data; a coded ancillary audio data selecting/outputting unit which, when it has received the ancillary audio selection data, selects, from among stored 1st to Nth (N: integer not less than 2) coded ancillary audio data, desired coded ancillary audio data according to the inputted ancillary audio selection data; an ancillary audio decoding unit which decodes the selected coded ancillary audio data to output decoded ancillary audio data; a decoding unit which decodes the coded audio data to output decoded audio data; and an audio synthesis unit which synthesizes the decoded audio data and the decoded ancillary audio to output a synthesis audio. Therefore, it is possible to obtain an audio decoding apparatus which can decode a stream outputted from an audio coding apparatus, which stream includes coded audio data and auxiliary data including ancillary audio selection data, and which can output an audio signal synthesizing the audio data and the ancillary audio data.

According to a seventh aspect of the present invention, there is provided an audio decoding apparatus which decodes the coded audio data and the auxiliary data which are outputted from the audio coding apparatus as defined in Claim 5, and synthesizes, from both of the decoded data, an audio signal and outputs the same, which apparatus comprises: an ancillary audio selection data/coding related data extraction unit which extracts, from the auxiliary data, the ancillary audio selection data and the coding related data as the specific data, and outputs both of the extracted data; an ancillary audio selecting/outputting unit which, when it has received the ancillary audio selection data, selects, from among stored 1st to Nth (N: integer not less than 2) ancillary audio data, desired ancillary audio data according to the inputted ancillary audio selection data; a decoding unit which decodes the coded audio data to output decoded audio data; and an audio synthesis unit which synthesizes the decoded audio data and the selected ancillary audio data, and outputs a synthesis audio. Therefore, it is possible to obtain an audio decoding apparatus which can decode a stream outputted from an audio coding apparatus, which stream includes coded audio data and auxiliary data including ancillary audio selection data, and which can output an audio signal synthesizing the audio data and the ancillary audio data.

DETAILED DESCRIPTION OF THE PREFERRED EMBODIMENTS

Hereinafter, audio coding apparatuses and audio decoding apparatuses according to the present invention will be described with reference to the drawings.

Embodiment 1

Initially, a first embodiment of the present invention corresponding to Claims 1 and 3 will be described.

In this first embodiment, coding and decoding of audio, and further, coding and decoding of ancillary audio are performed using MPEG1-Layer II.

Figure 1:
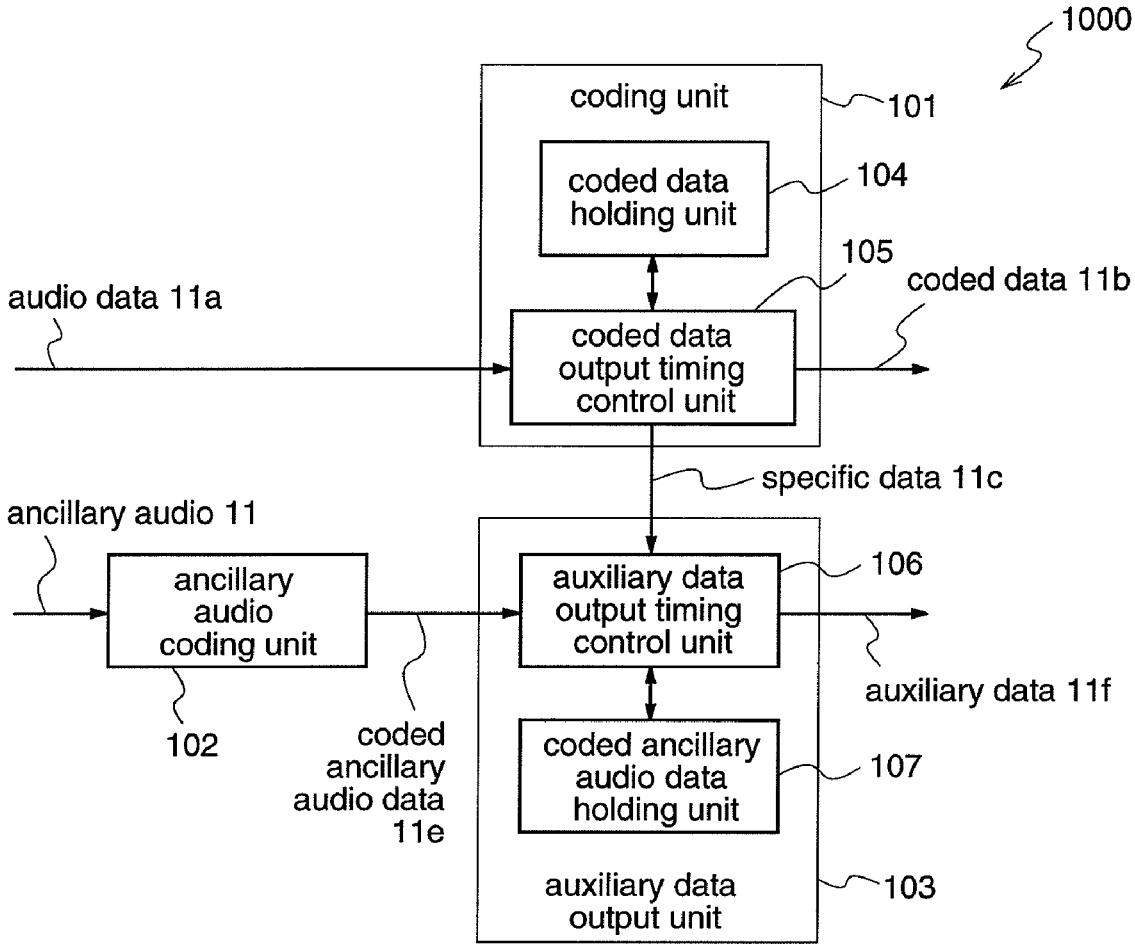
FIG. 1 is a block diagram illustrating the construction of an audio coding apparatus 1000 according to a first embodiment of the present invention.

FIG. 1 is a block diagram illustrating the construction of an audio coding apparatus 1000 according to the first embodiment of the present invention.

In FIG. 1, reference numeral 101 denotes a coding unit which receives audio data 11*a*, and encodes the same to output coded data 11*b* and coding related data used for the coding as specific data 11*c*.

Further, reference numerals 104 and 105 denote a coded data holding unit and a coded data output timing control unit, which constitute the coding unit 101. The coded data output timing control unit 105 receives the audio data 11*a*, and encodes the audio data 11*a* to output the coded data 11*b* and the specific data 11*c* to the coded data holding unit 104 so as to make the holding unit 104 hold these data, and further, it reads out the coded data 11*b* and the specific data 11*c* from the coded data holding unit 104 at a controlled timing to output these data.

Reference numeral 102 denotes an ancillary audio coding unit which receives ancillary audio 11, and encodes the ancillary audio 11 to output coded ancillary audio data 11*e*.

Reference numeral 103 denotes an auxiliary data output unit which receives the specific data 11*c* and the coded ancillary audio data 11*e*, and outputs auxiliary data 11*f* at a desired timing.

Further, reference numerals 106 and 107 denote an auxiliary data output timing control unit and a coded ancillary audio data holding unit, which constitute the auxiliary data output unit 103. The auxiliary data output timing control unit 106 receives the specific data 11*c* and the coded ancillary audio data 11*e*, and exchanges the coded ancillary audio data 11*e* with the coded ancillary audio data holding unit 107, and outputs the auxiliary data 11*f* at a controlled timing.

Figure 3:
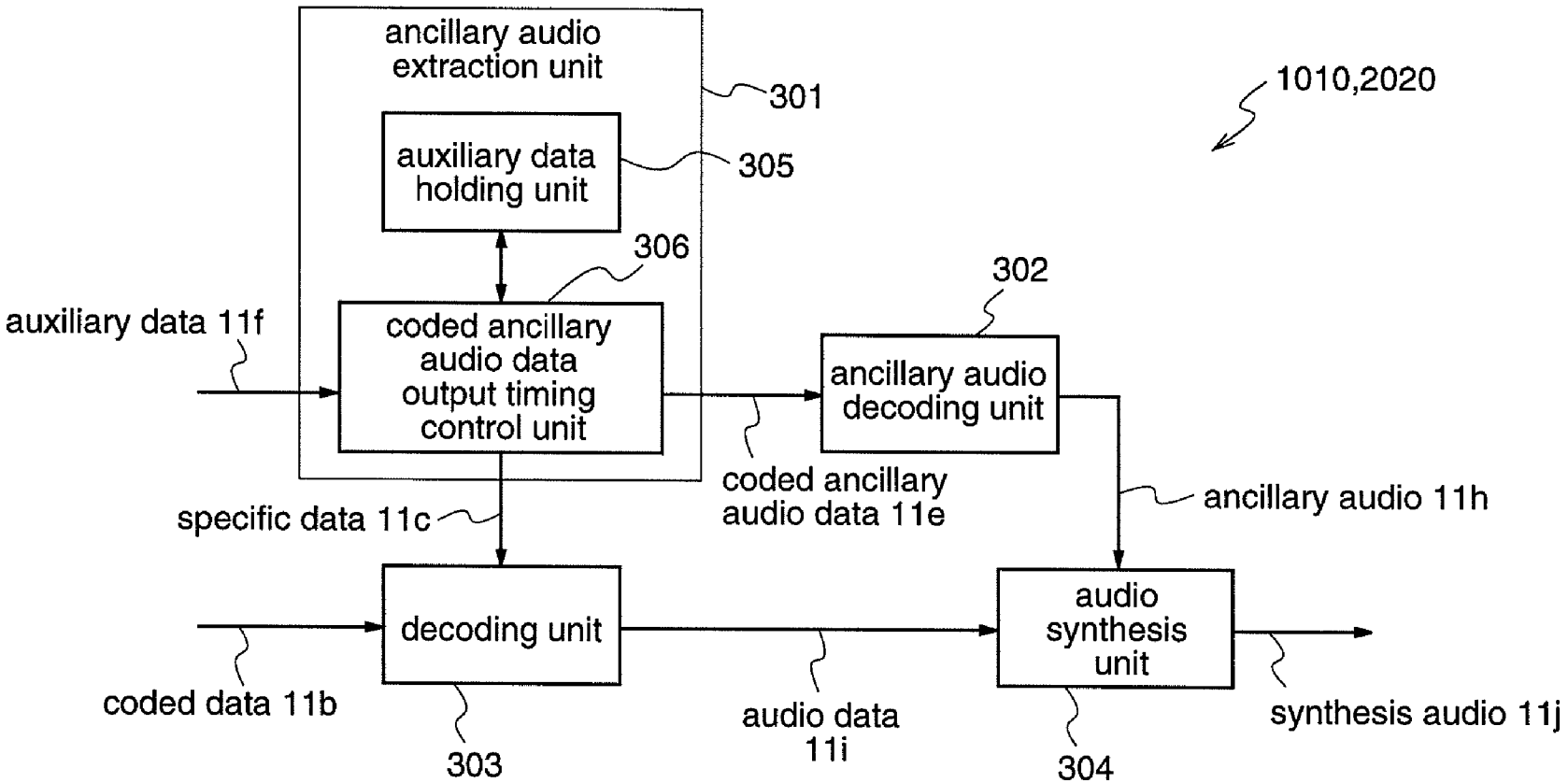
FIG. 3 is a block diagram illustrating the construction of an audio decoding apparatus 1010 according to the first embodiment of the present invention.

FIG. 3 is a block diagram illustrating the construction of an audio decoding apparatus 1010 according to the first embodiment.

In FIG. 3, reference numeral 301 denotes an ancillary audio extraction unit which receives the auxiliary data 11*f* outputted from the audio coding apparatus 1000, and extracts, from the auxiliary data 11*f*, the coded ancillary audio data 11*e* as well as the specific data 11*c* as the coding related data to output these data to the decoding unit 303. Further, reference numerals 305 and 306 denote an auxiliary data holding unit and a coded ancillary audio data output timing control unit, which constitute the ancillary audio extraction unit 301.

Reference numeral 302 denotes an ancillary audio decoding unit which receives the coded ancillary audio data 11*e*, and decodes the same to output ancillary audio 11*h*.

Further, reference numeral 303 denotes a decoding unit which receives the coded data 11*b* outputted from the audio coding apparatus 1000, and decodes the coded data 11*b* with reference to the specific data 11*c* which is the coding related data from the ancillary audio extraction unit 301, thereby to output audio data 11*i*. Reference numeral 304 denotes an audio synthesis unit which synthesizes the audio data 11*i* from the decoding unit 303 and the ancillary audio 11*h* from the ancillary audio decoding unit 302 to output synthesis audio 11*j*.

Figure 4:
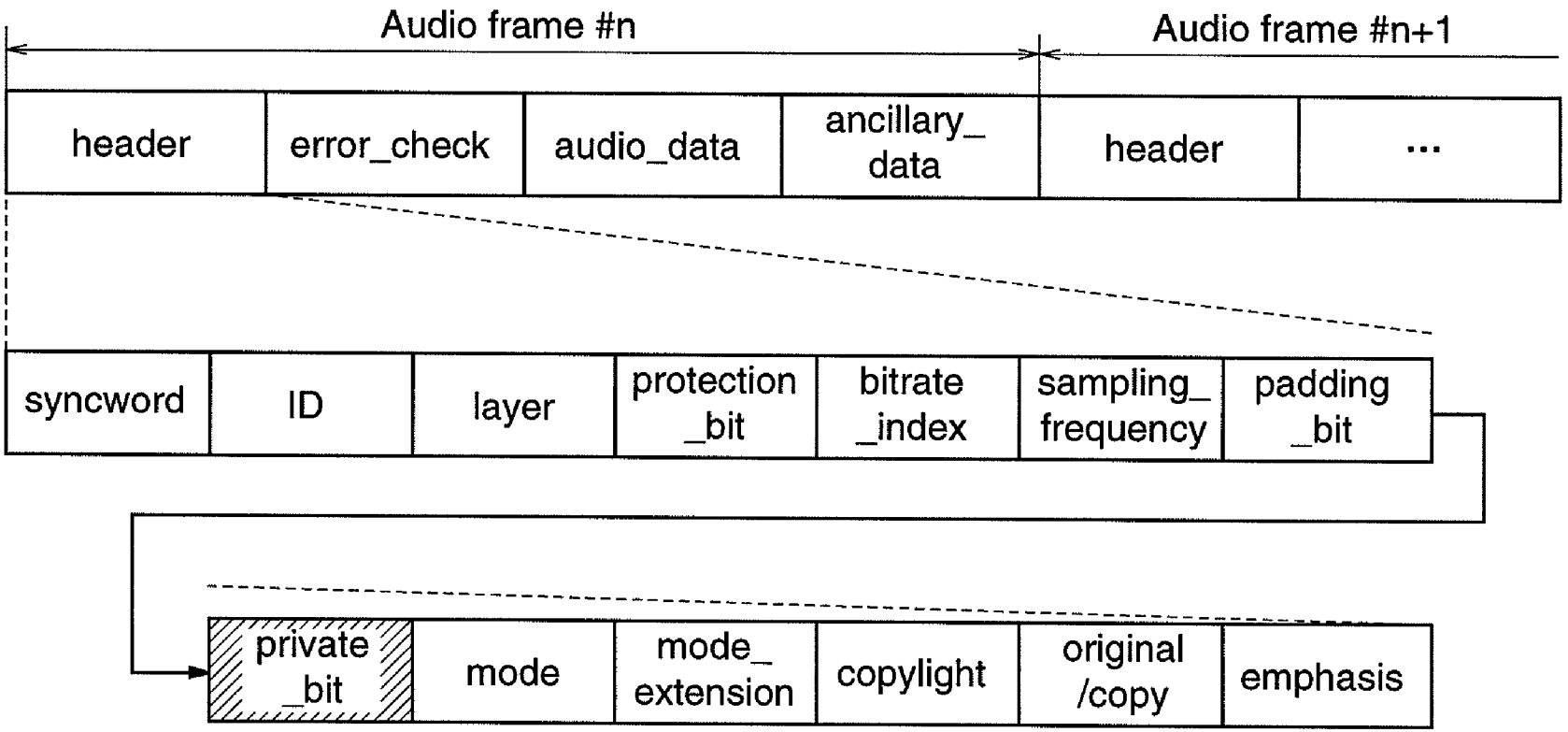
FIG. 4 is a diagram for explaining a format of an audio frame based on the MPEG1-Layer II standard.

FIG. 4 is a diagram illustrating a format of an audio frame of MPEG1-Layer II. In FIG. 4, Audio Frame includes a header area, an Error_check area, an audio_data area, and an ancillary_data area. The header area includes various kinds of data areas such as "syncword", "ID", "layer", "protection_bit", "bitrate_index", "sampling_frequency", "padding_bit", "private_bit", "mode", "mode_extention", "copyright", "original/copy", and "emphasis".

Hereinafter, the operations of the audio coding apparatus 1000 and the audio decoding apparatus 1010 according to the first embodiment will be described with reference to FIGS. 1, 3, and 4.

Initially, the operation of the audio coding apparatus 1000 will be described.

On receipt of the audio data 11*a*, the coded data output timing control unit 105 in the coding unit 101 encodes the same, and outputs the coded data and the coding related data (specific data) used for the coding as frames to the coded data holding unit 104. When the coding is performed according to the rule of MPEG1-Layer II, "bitrate_index" indicating a bit rate, "mode" indicating a channel code, "mode_extension" indicating a boundary between bands, and the like which are included in the header area of the audio frame as shown in FIG. 4 are outputted as the coding related data.

After the coded data output timing control unit 105 outputs 1000 frames to the coded data holding unit 104, it reads out the frames from the coded data holding unit 104 in the order of inputting. The coded data output timing control unit 105 outputs, from the frames that have been successively read out from the coded data holding unit 104, the coded data 11*b* as well as the specific data 11*c* as the coding related data to the auxiliary data output timing control unit 106 in the auxiliary data output unit 103. Thus, the coded data 11*b* and the specific data 11*c* are outputted delayed by 1000 frames. While the number of frames to be held in the coded data holding unit 104 is 1000 in this first embodiment, it is not restricted thereto.

On the other hand, on receipt of the ancillary audio 11, the ancillary audio coding unit 102 encodes the inputted ancillary audio 11 by MPEG1-Layer II coding, and outputs the coded ancillary audio data 11*e* to the auxiliary data output timing control unit 106 in the auxiliary data output unit 103. In this first embodiment, since the user can input arbitrary audio as the ancillary audio 11, it is possible to encode various kinds of ancillary audio in contract to the other embodiments described later.

On receipt of the coded ancillary audio data 11*e*, the auxiliary data output timing control unit 106 detects the number of bits of the inputted coded ancillary audio data 11*e*, and stores the coded ancillary audio data 11*e* in the coded ancillary audio holding unit 107. The auxiliary data output timing control unit 106 inserts the coded ancillary audio data 11*e* which is stored in the coded ancillary audio data holding unit 107 into "private_bit" in the header area (header) so that coded ancillary audio data for ancillary audio can be collected at the decoding apparatus end by the time when the ancillary audio is outputted from the decoding apparatus, and outputs the auxiliary data 11*f*.

Since the playback time for one audio frame has been known, the auxiliary data output timing control unit 106 determines from which specific data timing the coded ancillary audio data 11*e* should be inserted into "private_bit" in the header area, among the specific data 11*c* which are inputted delayed by 1000 frames as described above, according to the detected number of bits of the coded ancillary audio data 11*e*. Until the desired specific data is inputted, the inputted specific data are outputted as they are, as the auxiliary data 11*f*. After the desired specific data is inputted, the coded ancillary audio data 11*e* stored in the coded ancillary audio data holding unit 107 are successively inserted by 2 bits into "private_bit" in the header area to be outputted as the auxiliary data 11*f*. This operation is repeated until the coded ancillary audio data 11*e* stored in the coded ancillary audio data holding unit 107 are completely outputted.

The outputted coded data 11*b* and auxiliary data 11*f* are multiplexed in a multiplexing circuit in the subsequent stage (not shown) to be outputted as a stream as shown in FIG. 4.

In this first embodiment, as described above, "private_bit" (2 bits) in the header area (header) of the audio frame in the MPEG1-Layer II stream is used as storage bits for storing the coded ancillary audio data 11*e* in the auxiliary data. Since the coded ancillary audio data 11*e* are thus embedded in the area such as "private_bit" which is opened to the user in MPEG1-Layer II, even if decoding is performed by the conventional decoding apparatus which does not treat the data in such area as significant data, the decoding operation is not adversely affected. Further, since the area which has originally been prepared in each standard is used for the storage of the coded ancillary audio data 11*e*, it is avoided that the amount of bits is undesirably increased due to the coded ancillary audio data included.

While in this first embodiment the auxiliary data output unit 103 embeds the coded ancillary audio data 11*e* in the two-bit "private_bit" that is included in the header area of the audio frame, the coded ancillary audio data 11*e* may be embedded in another area opened to the user, such as a "ancillary_data" area in the audio frame.

Figure 5:
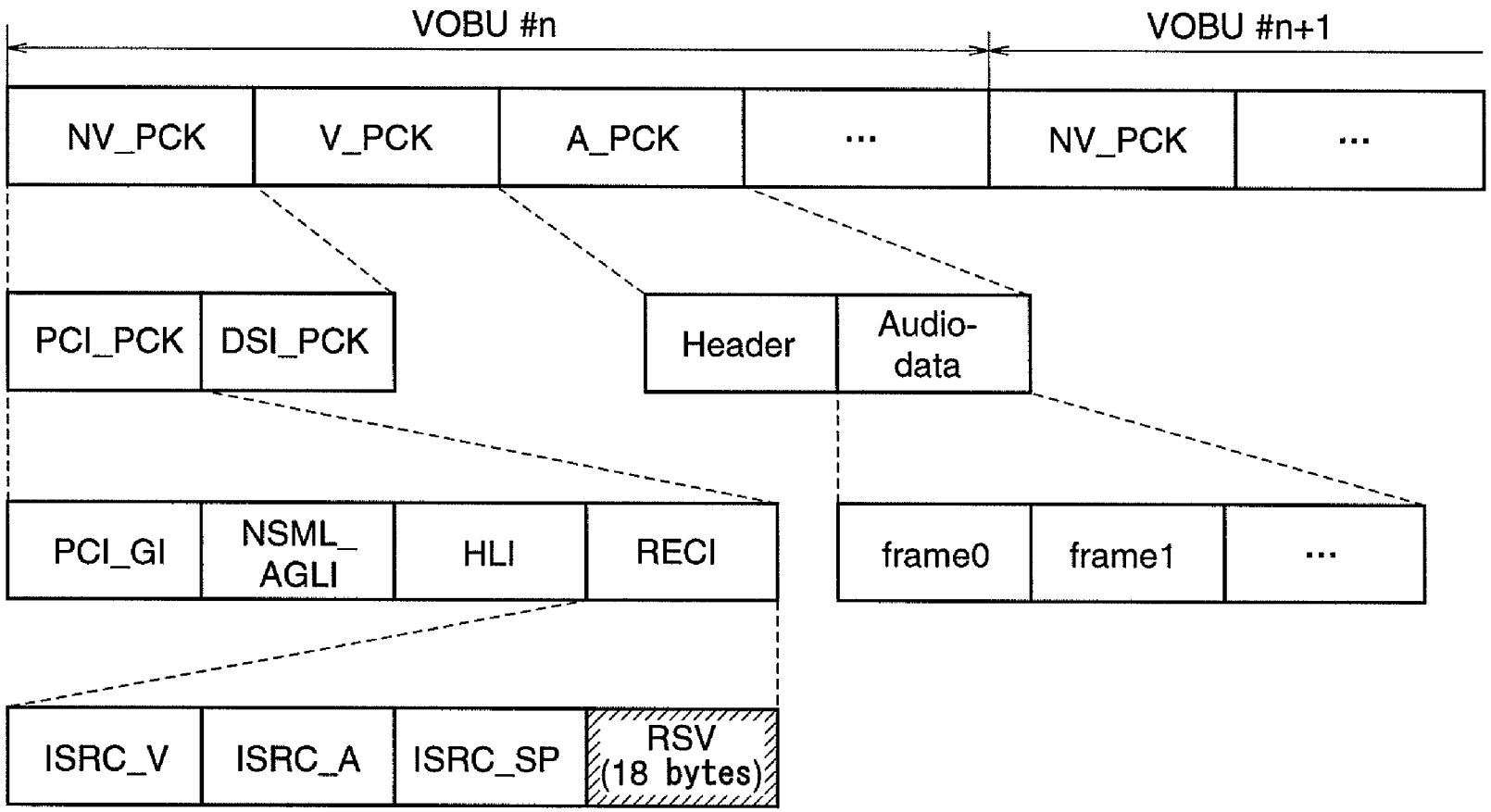
FIG. 5 is a diagram illustrating the construction of VOBU based on the DVD-Video standard.

Further, the coded ancillary audio data 11*e* may be embedded in an area that is secured as a system or in an excessive area. For example, a DVD-Video standard shown in FIG. 5 is managed in units of VOBU, and system information called a NV_PCK pack is certainly included in each VOBU. Playback control information called a PCI_PCK pack is included in the NV_PCK pack, and the last 18 bytes are a Reserved area which is not defined. Accordingly, the coded ancillary audio data 11*e* may be embedded in this Reserved area.

Further, as for an area which is defined in each standard but is not utilized as a system, the coded ancillary audio data 11*e* may be embedded in this area.

Next, the audio decoding apparatus 1010 according to the first embodiment will be described.

On receipt of the auxiliary data 11*f*, the coded ancillary audio data output timing control unit 306 in the ancillary audio extraction unit 301 extracts "private_bit" from the auxiliary data 11*f*, and stores the extracted data in the auxiliary data holding unit 305. Further, the coded ancillary audio data output timing control unit 306 outputs the auxiliary data 11*f* as the specific data 11*c* to the decoding unit 303. Further, when the coded ancillary audio data 11*e* equivalent to one audio frame are accumulated in the auxiliary data holding unit 305, the coded ancillary audio data output timing control unit 306 outputs the data to the ancillary audio decoding unit 302.

On receipt of the coded ancillary audio data 11*e*, the ancillary audio decoding unit 302 decodes the data 11*e* to output the decoded ancillary audio 11*h* to the audio synthesis unit 304.

Further, on receipt of the coded data 11*b*, the decoding unit 303 decodes the data 11*b* to output the decoded audio data 11*i* to the audio synthesis unit 304.

The audio synthesis unit 304 synthesizes the inputted audio data 11*i* and ancillary audio 11*h* to output synthesis audio 11*j*.

According to the above-described operation, the audio decoding apparatus 1010 of the first embodiment can reproduce and output the audio comprising the decoded audio data and the desired ancillary audio synthesized.

As described above, according to the first embodiment, an audio coding apparatus is constituted having an audio coding unit which, when it has received an audio signal input, performs coding to the audio signal input to output coded audio data as well as coding related data which is data relating to the coding as specific data, an ancillary audio coding unit which, when it has received an ancillary audio signal, performs coding to the ancillary audio signal to output coded ancillary audio data, and an auxiliary data output unit which produces, from the specific data and the coded auxiliary data, auxiliary data including both of the specific data and the ancillary audio data to output the auxiliary data, while an audio decoding apparatus is constituted having an ancillary audio extraction unit which extracts, from the auxiliary data, the coded ancillary audio data to output the same, an ancillary audio decoding unit which decodes the coded ancillary audio data to output decoded ancillary audio, an audio decoding unit which decodes the coded audio data to output decoded audio data, and an audio synthesis unit which synthesizes the audio data decoded by the audio decoding unit and the ancillary audio decoded by the ancillary audio decoding unit to output synthesis audio data. Therefore, the coding apparatus can output a stream comprising the coded audio data and the auxiliary data including the coded ancillary audio data, and the decoding apparatus can decode the inputted stream to output an audio signal comprising the audio data and the ancillary audio synthesized.

While in this first embodiment the coding and decoding of audio data are performed based on the rule of MPEG1-Layer II, the rule for the coding and decoding of audio data is not restricted thereto.

Embodiment 2

Next, a second embodiment of the present invention corresponding to Claims 2 and 4 will be described.

In this second embodiment, coding and decoding of audio as well as coding and decoding of ancillary audio are performed using MPEG1-Layer II, as in the first embodiment.

Figure 2:
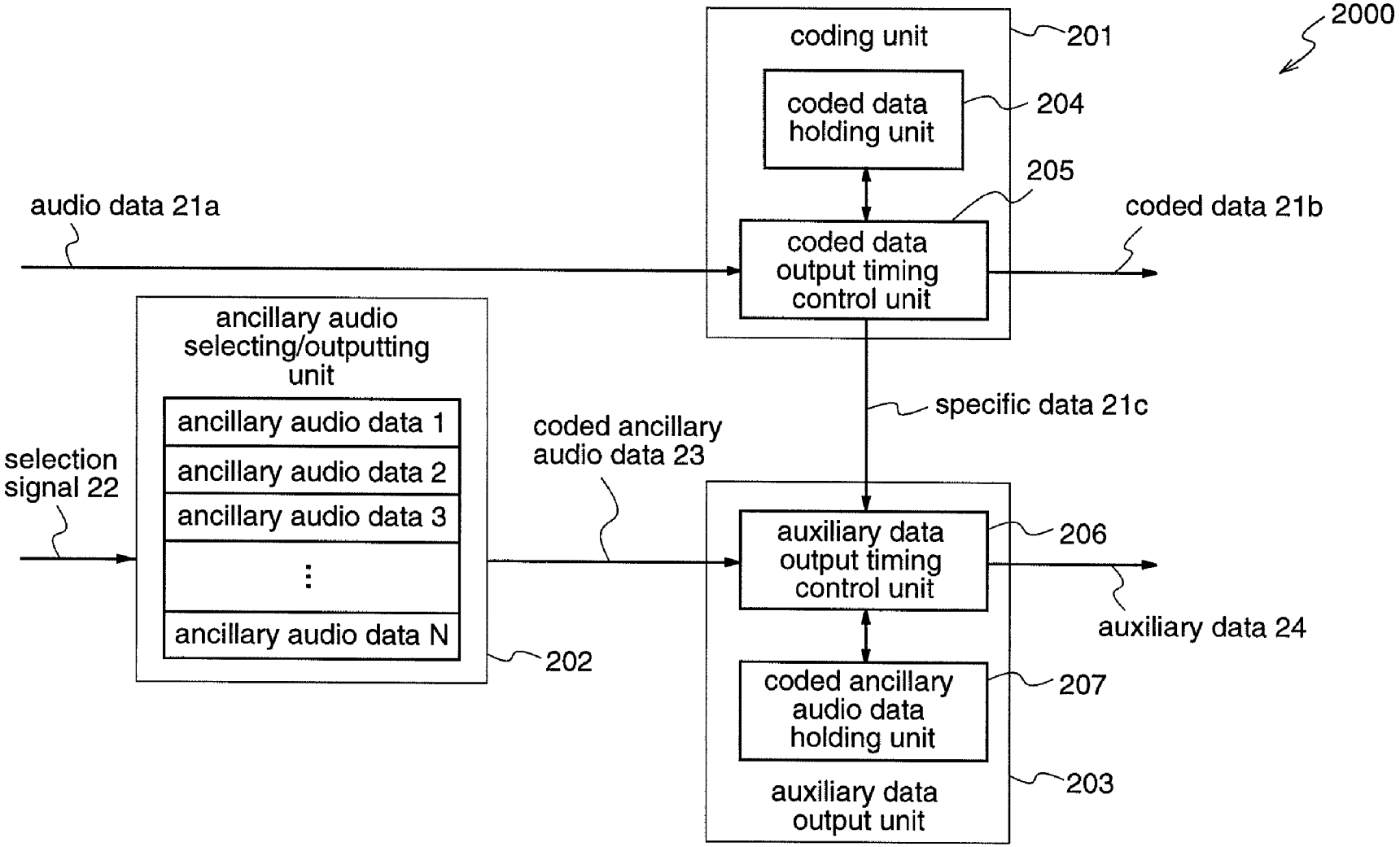
FIG. 2 is a block diagram illustrating the construction of an audio coding apparatus 2000 according to a second embodiment of the present invention.

FIG. 2 is a block diagram illustrating the construction of an audio coding apparatus 2000 according to the second embodiment.

In FIG. 2, reference numeral 201 denotes an audio coding unit which receives audio data 21*a*, and encodes the audio data 21*a* to output coded data 21*b* as well as coding related data used for the coding as specific data 21*c*.

Further, reference numerals 204 and 205 denote a coded data holding unit and a coded data output timing control unit, which constitute the coding unit 201. The coded data output timing control unit 205 receives the audio data 21*a*, and encodes the same to output the coded data 21*b* and the specific data 21*c* to the coded data holding unit 204, and further, it reads out the coded data 21*b* and the specific data 21*c* from the coded data holding unit 204 at a controlled timing to output the same.

Reference numeral 202 denotes an ancillary audio selecting/outputting unit which receives a selection signal 22, and selects coded ancillary audio data 23 corresponding to the selection signal 22 from among plural ancillary audio data 1 to N to output the selected data.

Reference numeral 203 denotes an auxiliary data output unit which receives the specific data 21*c* that is the relating data used for the coding, which is outputted from the coding unit 201, as well as the coded ancillary audio data 23 outputted from the ancillary audio selecting/outputting unit 202, and produces auxiliary data 24.

Further, reference numerals 206 and 207 denote an auxiliary data output timing control unit and a coded ancillary audio data holding unit, which constitute the auxiliary data output unit 203. The auxiliary data output timing control unit 206 receives the specific data 21*c* and the coded ancillary audio data 23, and exchanges the coded ancillary audio data 23 with the coded ancillary audio data holding unit 307, and outputs the auxiliary data 24 at a controlled timing.

Since the construction of an audio decoding apparatus 2020 of the second embodiment is identical to the construction of the decoding apparatus 1010 of the first embodiment described with reference to FIG. 3, repeated description is not necessary.

Hereinafter, the operations of the audio coding apparatus 2000 and the audio decoding apparatus 202 according to the second embodiment will be described with reference to FIGS. 2, 3, and 4.

Initially, the audio coding apparatus 2000 will be described.

On receipt of the audio data 21*a*, the coded data output timing control unit 205 in the coding unit 201 encodes the same to output the coded data and the coding related data (specific data) used for the coding as frames to the coded data holding unit 204. As in the first embodiment, when the coding is performed based on the rule of MPEG1-Layer II, such as "bitrate_index" indicating the bit rate, "mode" indicating the channel code, and "mode_extension" indicating the boundary between bands, which are included in the header area in the audio frame as shown in FIG. 3, are outputted as the coding related data.

After the coded data output timing control unit 205 outputs 1000 frames to the coded data holding unit 204, it reads out the frames in the order of inputting from the coded data holding unit 204. The coded data output timing control unit 205 outputs, from the frames which have been successively read out from the coded data holding unit 204, the coded data 21*b* as well as the specific data 21*c* as the coding related data to the auxiliary data output timing control unit 206 in the auxiliary data output unit 203. That is, the coded data 21*b* and the specific data 21*c* are outputted delayed by 1000 frames. While in this second embodiment the number of frames held in the coded data holding unit 204 is 1000, the present invention is not restricted thereto.

On the other hand, on receipt of the selection signal 22, the ancillary audio selecting/outputting unit 202 outputs the ancillary audio data which is selected according to the selection signal 22 from among the plural ancillary audio data coded in the format of MPEG1-Layer II which are stored inside, as the coded ancillary audio data 23 to the auxiliary data output timing control unit 206 in the auxiliary data output unit 203. Since, in this second embodiment, the coded ancillary audio data are previously stored in the ancillary audio selecting/outputting unit 202 and the stored coded ancillary audio data are selected and outputted, it is unnecessary to encode the ancillary audio at the coding end.

On receipt of the coded ancillary audio data 23, the auxiliary data output timing control unit 206 detects the number of bits of the inputted coded ancillary audio data 23, and stores the coded ancillary audio data 23 into the coded ancillary audio data holding unit 207. The auxiliary data output timing control unit 206 inserts the coded ancillary audio data 23 stored in the coded ancillary audio data holding unit 207, into "private_bit" in the header area (header) so that coded ancillary audio data for ancillary audio can be collected at the decoding apparatus end by the time when the ancillary audio is outputted from the decoding apparatus, and outputs the auxiliary data 24.

Since the playback time for one audio frame has already been known, the auxiliary data output timing control unit 206 determines from which specific data timing the coded ancillary audio data 23 should be inserted into "private_bit" in the header area, among the specific data 21*c* which are inputted delayed by 1000 frames as described above, according to the detected number of bits of the coded ancillary audio data. Until the desired specific data is inputted, the inputted specific data 21*c* are outputted as they are, as the auxiliary data 24. After the desired specific data is inputted, the coded ancillary audio data 23 stored in the coded ancillary audio data holding unit 207 are successively inserted by 2 bits into "private_bit" in the header area to be outputted as the auxiliary data 24. This operation is repeated until the coded ancillary audio data 23 stored in the coded ancillary audio data holding unit 207 are completely outputted.

The outputted coded data 21*b* and auxiliary data 24 are multiplexed by a multiplexing circuit (not shown) in the subsequent stage to be outputted as a stream shown in FIG. 4.

As described above, also in this second embodiment, "private_bit" (2 bits) in the header area (header) of the audio frame in the MPEG1-Layer II stream is used as storage bits for storing the coded ancillary audio data 23 in the auxiliary data. Since the coded ancillary audio data 23 are embedded in the area such as "private_bit" which is opened to the user in MPEG1-Layer II, even if decoding is performed by the conventional decoding apparatus which does not treat the data in such area as significant data, the decoding operation is not adversely affected. Further, since the area which has originally been prepared in each standard is used for the storage of the coded ancillary audio data 23, it is avoided that the amount of bits is undesirably increased due to the coded ancillary audio data 23 included.

While in this second embodiment the auxiliary data output unit 203 embeds the coded ancillary audio data 23 into the 2-bit "private_bit" that is included in the header area in the audio frame, the coded ancillary audio data 23 may be embedded in another area opened to the user, such as an "ancillary_data" area in the audio frame.

Further, as already described in the first embodiment, the coded ancillary audio data 23 may be embedded in an area which is secured as a system or an excessive area, such as the Reserved area in the DVD-Video standard.

Next, the audio decoding apparatus 2020 according to the second embodiment will be described.

When the coded ancillary audio data output timing control unit 306 in the ancillary audio extraction unit 301 receives the auxiliary data 24, it extracts "private_bit" from the auxiliary data 24, and stores the extracted data in the auxiliary data holding unit 305. Further, the coded ancillary audio data output timing control unit 306 outputs the auxiliary data 24 as the specific data to the decoding unit 303. When the coded ancillary audio data equivalent to one audio frame are accumulated in the auxiliary data holding unit 305, the coded ancillary audio data output timing control unit 306 outputs these data to the ancillary audio decoding unit 302.

On receipt of the coded ancillary audio data, the ancillary audio decoding unit 302 decodes the same to output the decoded ancillary audio to the audio synthesis unit 304.

Further, on receipt of the coded data 21*b*, the decoding unit 303 decodes the same to output the decoded audio data to the audio synthesis unit 304.

The audio synthesis unit 304 synthesizes the inputted audio data and ancillary audio data to output synthesis audio.

Thereby, according to the second embodiment, it is possible to reproduce and output the audio comprising the decoded audio data and the desired ancillary audio synthesized.

As described above, according to the second embodiment, an audio coding apparatus is constituted having an audio coding unit which, when it has received an audio signal input, performs coding to the audio signal input to output coded audio data as well as coding related data which is data relating to the coding as specific data, an ancillary audio selecting/outputting unit which, with storing a plurality of ancillary audio data, selects one of the stored ancillary audio data according to an inputted selection signal to output the selected data as coded ancillary audio data, and an auxiliary data output unit which produces, from the specific data and the coded ancillary audio data, auxiliary data including both of the specific data and the coded ancillary audio data to output the auxiliary data, while an audio decoding apparatus is constituted having an ancillary audio extraction unit which extracts, from the auxiliary data, the coded ancillary audio data to output the same, an ancillary audio decoding unit which decodes the coded ancillary audio data to output decoded ancillary audio, an audio decoding unit which decodes the coded audio data to output decoded audio data, and an audio synthesis unit which synthesizes the audio data decoded by the audio decoding unit and the ancillary audio decoded by the ancillary audio decoding unit to output synthesis audio data. Therefore, the coding apparatus can output a stream comprising the coded audio data and the auxiliary data including the coded ancillary audio data, and the decoding apparatus can decode the inputted stream to output an audio signal comprising the audio data and the ancillary audio synthesized.

While in this second embodiment the coding and decoding of the audio data are performed based on the rule of MPEG1-Layer II, the rule for the coding and decoding of the audio data is not restricted thereto.

Embodiment 3

Next, a third embodiment of the present invention corresponding to Claims 5 and 6 will be described.

In this third embodiment, coding and decoding of audio as well as decoding of ancillary audio are performed based on MPEG1-Layer II. However, the present invention is not restricted thereto.

Figure 6:
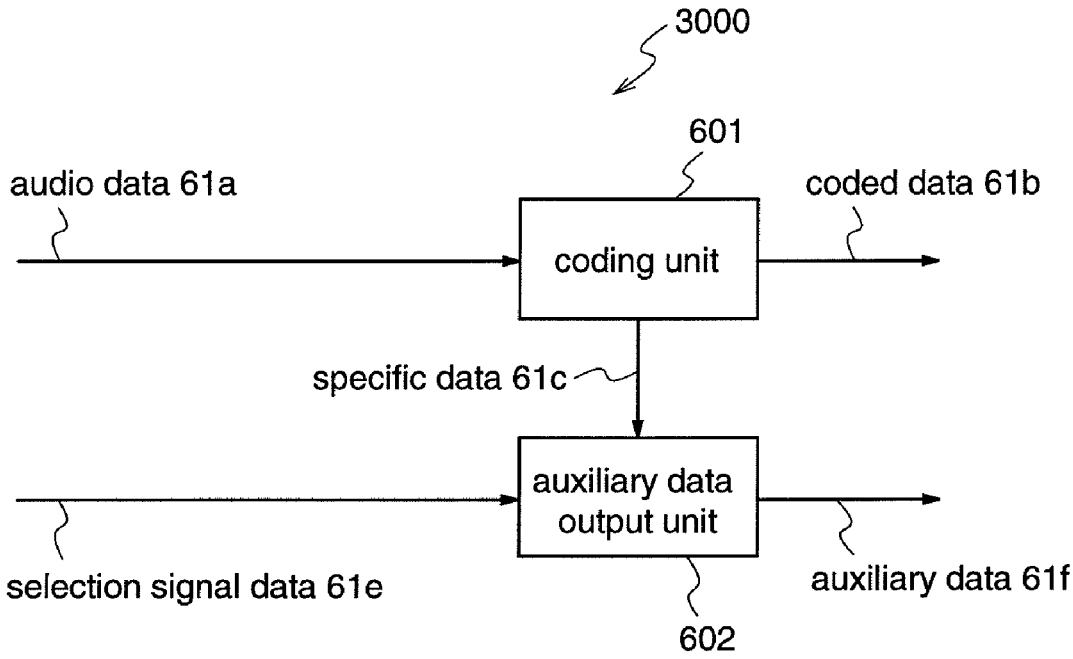
FIG. 6 is a block diagram illustrating the construction of an audio coding apparatus 3000 according to a third embodiment of the present invention.

FIG. 6 is a block diagram illustrating the construction of an audio coding apparatus 3000 according to the third embodiment of the present invention.

In FIG. 6, reference numeral 601 denotes an audio coding unit which receives audio data 61*a*, and encodes the audio data 61*a* to output coded data 61*b* as well as coding related data used for the coding as specific data 61*c*.

Reference numeral 602 denotes an auxiliary data output unit which receives selection signal data 61*e* and the specific data 61*c* from the coding unit 601, and outputs auxiliary data 61*f* including the selection signal data 61*e* and the specific data 61*c*.

Figure 7:
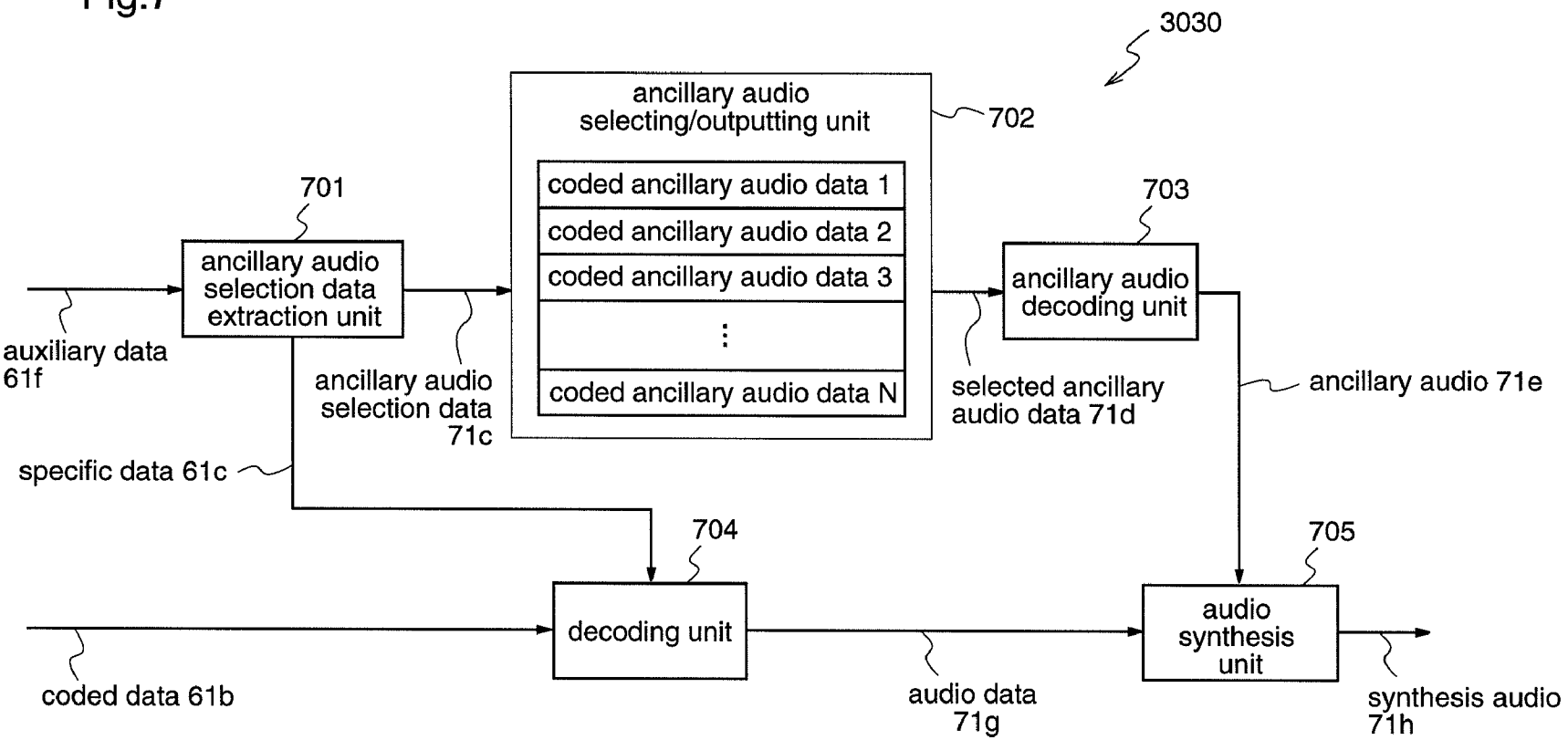
FIG. 7 is a block diagram illustrating the construction of an audio decoding apparatus 3030 according to the third embodiment of the present invention.

FIG. 7 is a block diagram illustrating the construction of an audio decoding apparatus 3030 according to the third embodiment of the present invention.

In FIG. 7, reference numeral 701 denotes an ancillary audio selection data extraction unit which extracts, from the inputted auxiliary data 61*f*, ancillary audio selection data 71*c* and the specific data 61*c* to output these data.

Reference numeral 702 denotes an ancillary audio selecting/outputting unit which selects, from among stored coded ancillary audio data 1 to N, one corresponding to the ancillary audio selection data 71*c* according to the inputted ancillary audio selection data 71*c*, and outputs the selected ancillary audio data 71*d*.

Reference numeral 703 denotes an ancillary audio decoding unit which receives the selected ancillary audio data 71*d*, and decodes the same to output ancillary audio 71*e*.

Reference numeral 704 denotes a decoding unit which receives the coded data 61*b*, and decodes the coded data 61*b* using the specific data 61*c* from the ancillary audio selection data extraction unit 701 to output the decoded audio data 71*g*.

Reference numeral 705 denotes an audio synthesis unit which synthesizes the audio data 71*g* outputted from the decoding unit 704 and the ancillary audio 71*e* outputted from the ancillary audio decoding unit 703 to output synthesis audio 71*h*.

Hereinafter, the operations of the audio coding apparatus 3000 and the audio decoding apparatus 3030 according to the third embodiment will be described with reference to FIGS. 6 and 7.

Initially, the audio coding apparatus 3000 will be described.

When the audio data 61*a* is input to the coding unit 601, the coding unit 601 encodes the inputted audio data 61*a* to output the coded data 61*b* as well as the coding related data used for the coding as the specific data 61*c* to the auxiliary data output unit 602.

Since, when the MPEG1-Layer II is adopted, the specific data 61*c* is fundamentally identical to that described in the first embodiment, description for the specific data will be omitted.

When the selection signal data 61*e* and the specific data 61*c* which is outputted from the coding unit 601 are input to the auxiliary data output unit 602, the auxiliary data output unit 602 produces the auxiliary data 61*f* including the selection signal data 61*e* and the specific data 61*c* and outputs the same.

When the auxiliary data output unit 602 receives the specific data 61*c* and the selection signal data 61*e*, it inserts the selection signal data 61*e* for selecting the ancillary audio into "private_bit" (2 bits) to produce the auxiliary data 61*f*. While in this third embodiment the selection signal data of 2 bits (four types) can be inputted to "private_bit" in one frame, the selection signal data is not restricted to that to be inserted in "private_bit" (2 bits) in one frame. If the selection signal data is inserted divided into "private-bit" in continuous plural frames, the number of selectable ancillary audio can be increased by the selection signal data of a larger bit number.

As described above, according to the third embodiment, "private_bit" (2 bits) in the header area (header) of the audio frame in the MPEG1-Layer II stream is used as the storage bits for storing the selection signal data 61*e* included in the auxiliary data. Since the selection signal data is thus embedded in the area such as "private_bit" which is opened to the user in MPEG1-Layer II, even when decoding is performed by the conventional decoding apparatus which does not treat the data in such area as significant data, the decoding operation is not adversely affected. Further, since the area which is originally prepared in each standard is used for the storage of the selection signal data, it is avoided that the amount of bits is increased due to the selection signal data included.

While in this third embodiment the auxiliary data output unit 602 embeds the selection signal data 61*a* into the 2-bit "private_bit" included in the header area in the audio frame, the selection signal data 61*e* may be embedded in another area which is opened to the user, such as an "ancillary_data" area in the audio frame.

Further, as already described in the first embodiment, the selection signal data 61*e* may be embedded in an area that is secured as a system or an excessive area, such as the Reserved area in the DVD-Video standard.

Next, the operation of the audio decoding apparatus 3030 according to the third embodiment will be described.

When the auxiliary data 61*f* is input to the ancillary audio selection data extraction unit 701, the ancillary audio selection data extraction unit 701 extracts "private_bit" from the auxiliary data 61*f* to output the specific data 61*c* to the decoding unit 704, and meanwhile, it outputs the ancillary audio selection data 71*c* to the ancillary audio selecting/outputting unit 702 when extraction of "private_bit" from one frame or continuous plural frames is completed.

On receipt of the ancillary audio selection data 71*c*, the ancillary audio selecting/outputting unit 702 outputs the coded ancillary audio data which is selected according to the ancillary audio selection data 71*c* from among the coded ancillary audio data 1 to N (refer to the format shown in FIG. 4) stored therein, as the selected ancillary audio data 71*d* to the ancillary audio decoding unit 703.

While in this third embodiment the coded ancillary audio data is based on the format shown in FIG. 4, the present invention is not restricted thereto.

On receipt of the selected ancillary audio data 71*d*, the ancillary audio decoding unit 703 decodes the selected ancillary audio data 71*d* to output the decoded ancillary audio 71*e* to the audio synthesis unit 705.

On the other hand, when the specific data 61*c* and the coded data 61*b* are input to the audio decoding unit 704, the audio decoding unit 704 decodes the coded data 61*b* using the specific data 61*c* as the coding related data, and outputs the decoded audio data 71*g* to the audio synthesis unit 705.

The audio synthesis unit 705 receives the decoded audio data 71*g* and the ancillary audio 71*e*, and synthesizes these data to output synthesis audio 71*h*.

According to the above-described operation, the audio decoding apparatus 3030 of the third embodiment decodes the ancillary audio selection data to output the ancillary audio, and processes the decoded audio data with this ancillary audio to obtain an audio output.

As described above, according to the third embodiment of the invention, an audio coding apparatus is constituted having an audio coding unit which, when it has received an audio signal input, performs coding to the audio signal input to output coded audio data as well as coding related data which is data relating to the coding as specific data, and an auxiliary data output unit which, when it has received an ancillary audio selection signal data for selecting ancillary audio, produces, from the ancillary audio selection signal data and the specific data outputted from the audio coding unit, auxiliary data to output the same, while an audio decoding apparatus is constituted having an ancillary audio selection data extraction unit which extracts, from the auxiliary data, the ancillary audio selection data and the coding related data as the specific data to output both of the extracted data, a coded ancillary audio data selecting/outputting unit which, when it has received the ancillary audio selection data, selects, from among stored 1st to Nth (N: integer not less than 2) coded ancillary audio data, desired coded ancillary audio data according to the inputted ancillary audio selection data, an ancillary audio decoding unit which decodes the selected coded ancillary audio data to output decoded ancillary audio, an audio decoding unit which decodes the coded audio data to output decoded audio data, and an audio synthesis unit which synthesizes the decoded audio data and the decoded ancillary audio to output synthesis audio data. Therefore, the coding apparatus can output a stream comprising the coded audio data and the auxiliary data including the ancillary audio selection data, and the decoding apparatus can decode the inputted stream to output an audio signal comprising the audio data and the ancillary audio synthesized.

Embodiment 4

Next, a fourth embodiment of the present invention corresponding to Claims 5 and 7 will be described.

While in this fourth embodiment coding and decoding of audio as well as decoding of ancillary audio will be described based on MPEG1-Layer II, the present invention is not restricted thereto.

In this fourth embodiment, the audio coding apparatus has the same construction as that of the third embodiment while the audio decoding apparatus has a construction different from that of the third embodiment.

Figure 8:
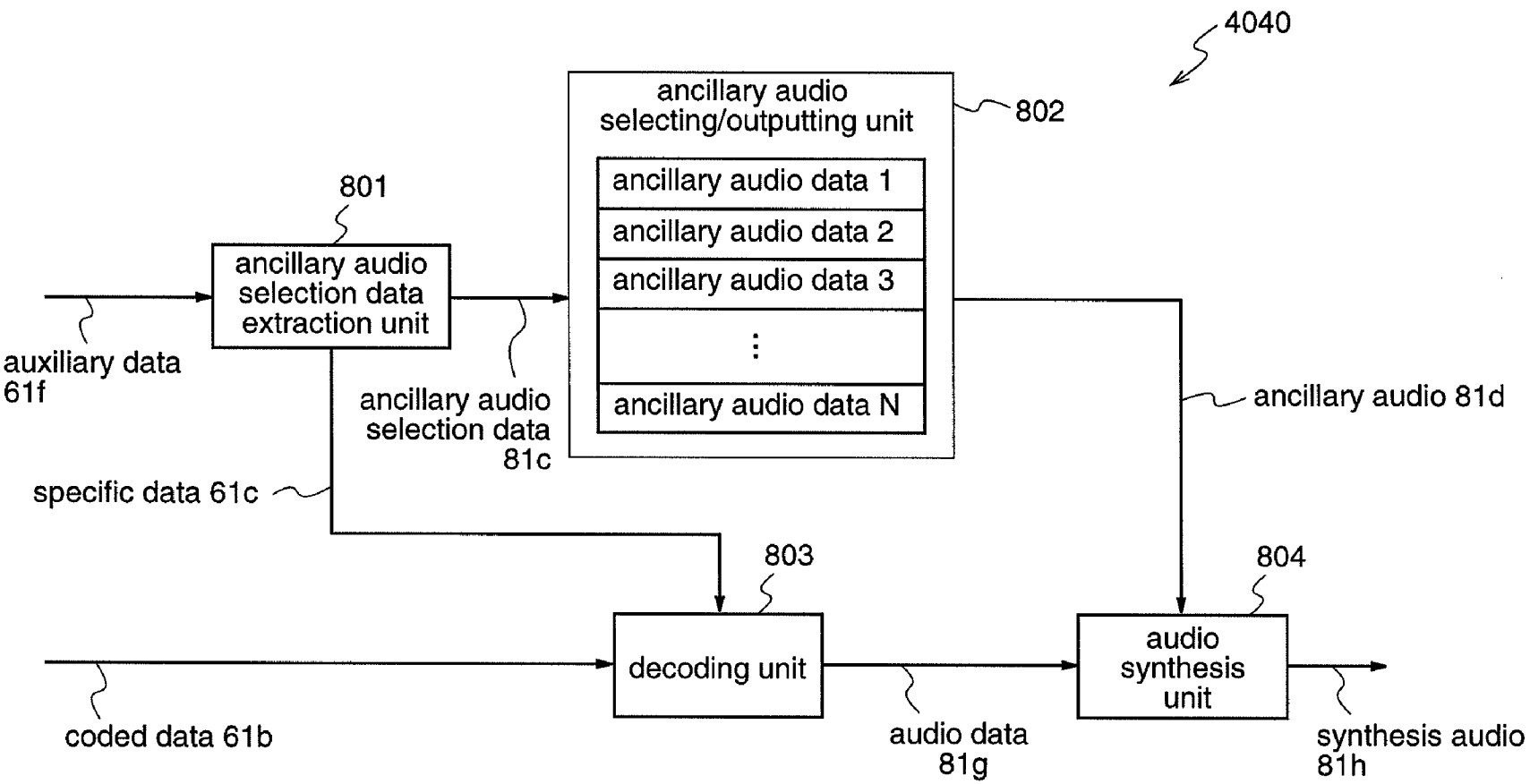
FIG. 8 is a block diagram illustrating the construction of an audio decoding apparatus 4040 according to a fourth embodiment of the present invention.
Figure 9:
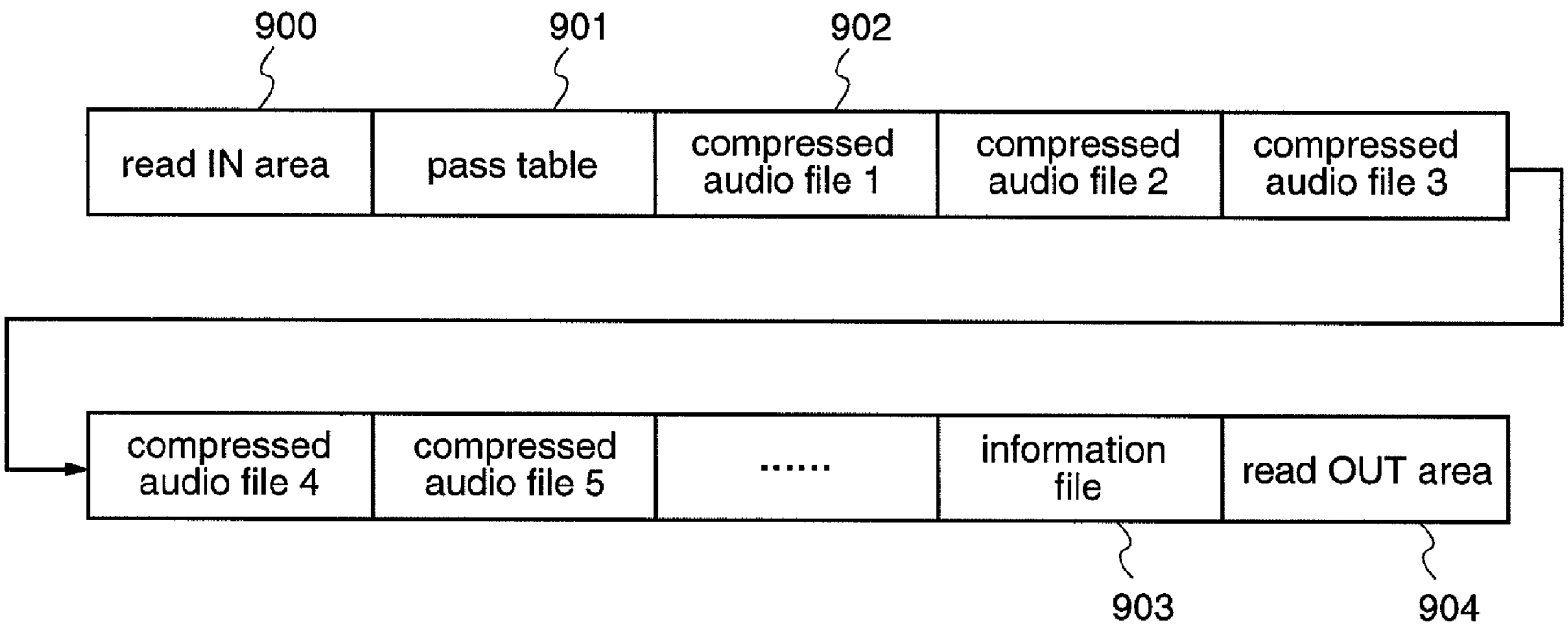
Fig.9 Prior Art
FIG. 9 is a diagram for explaining a format on a CD.
Figure 10:
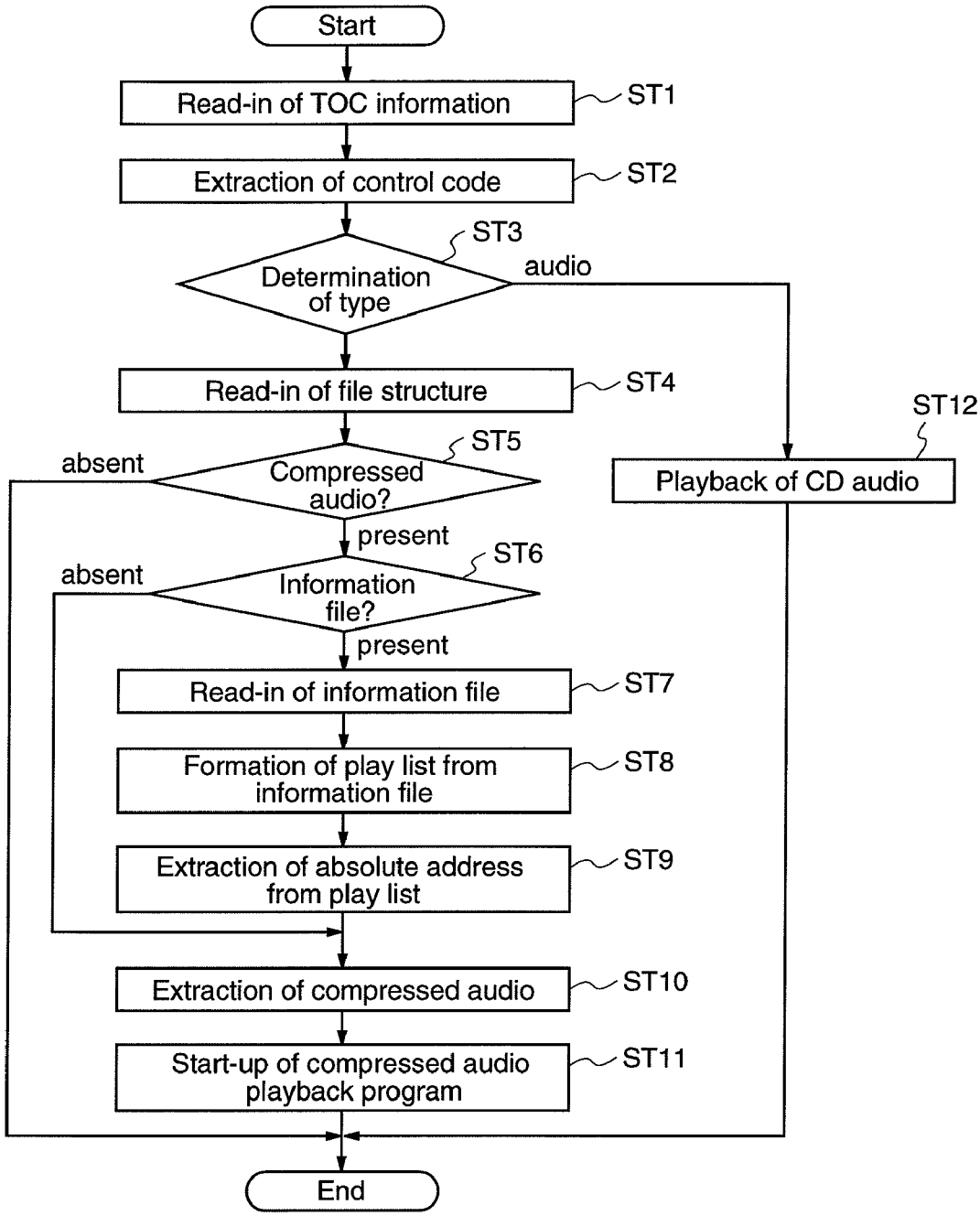
Fig.10 Prior Art
FIG. 10 is a diagram for explaining a flowchart of the conventional audio decoding apparatus.

FIG. 8 is a block diagram illustrating the construction of the audio decoding apparatus 4040 according to the fourth embodiment.

In FIG. 8, reference numeral 801 denotes an ancillary audio selection data extraction unit of the same construction as that of the third embodiment.

Reference numeral 802 denotes an ancillary audio selecting/outputting unit which receives the ancillary audio selection data 81*c* outputted from the ancillary audio selection data extraction unit 801, and selects one of the stored ancillary audio data 1 to N according to the ancillary audio selection data 81*c* to output the same as ancillary audio 81*d*.

Reference numeral 803 denotes an audio decoding unit which receives the coded data 61*b*, and decodes the same using the specific data 61*c* as the coding related data outputted from the ancillary audio selection data extraction unit 801 to output decoded audio data 81*g*.

Reference numeral 804 denotes an audio synthesis unit which synthesizes the audio data 81*g* outputted from the audio decoding unit 803 and the ancillary audio 81*d* outputted from the ancillary audio selecting/outputting unit 802 to output synthesis audio 81*h*.

Hereinafter, the operation of the fourth embodiment will be described with reference to FIG. 8.

Since the operation of the audio coding apparatus 4000 according to the fourth embodiment is identical to that of the audio coding apparatus 3000 according to the third embodiment, repeated description is not necessary.

Hereinafter, the operation of the audio decoding apparatus 4040 of the fourth embodiment will be described.

When the auxiliary data 61*f* is input to the ancillary audio selection data extraction unit 801, the ancillary audio selection data extraction unit 801 extracts "private_bit" from the auxiliary data 61*f*, and extracts the specific data 61*c* from "private_bit" to output the same to the decoding unit 803, and meanwhile, it outputs the ancillary audio selection data 81*c* to the ancillary audio selecting/outputting unit 802 when extraction of "private_bit" from one frame or continuous plural frames is completed.

On receipt of the ancillary audio selection data 81*c*, the ancillary audio selecting/outputting unit 802 outputs the ancillary audio data which is selected according to the ancillary audio selection data 81*c* from among the stored ancillary audio data 1 to N, as the ancillary audio 81*d* to the audio synthesis unit 804. In this fourth embodiment, since the ancillary audio selecting/outputting unit 802 stores a plurality of non-coded ancillary audio data and outputs the selected ancillary audio data, it is not necessary to provide a decoding unit for the ancillary audio on the decoding end, thereby simplifying the decoding apparatus.

On the other hand, when the specific data 61*c* and the coded data 61*b* are input to the decoding unit 803, the decoding unit 803 decodes the coded data 61*b* using the specific data 61*c* as the coding related data to output the decoded audio data 71*g* to the audio synthesis unit 804.

The audio synthesis unit 804 receives the decoded audio data 81*g* and the ancillary audio data 81*d*, and synthesizes these data to output synthesis audio 81*h*.

In this fourth embodiment, according to the above-described operation, ancillary audio is selected from the stored ancillary audio data 1 to N (N: integer not less than 2) according to the ancillary audio selection data, and the audio data itself is processed with this ancillary audio to obtain an audio output.

As described above, according to the fourth embodiment of the invention, an audio coding apparatus is constituted having an audio coding unit which, when it has received an audio signal input, performs coding to the audio signal input and outputs coded audio data and coding related data which is data relating to the coding as specific data, and an auxiliary data output unit which, when it has received ancillary audio selection signal data for selecting ancillary audio, produces, from the ancillary audio selection signal data and the specific data outputted from the audio coding unit, auxiliary data to output the same, while an audio decoding apparatus is constituted having an ancillary audio selection data extraction unit which extracts, from the auxiliary data, the ancillary audio selection data and the coding related data as the specific data to output both of the extracted data, an ancillary audio selecting/outputting unit which, when it has received the ancillary audio selection data, selects, from among stored 1st to Nth (N: integer not less than 2) ancillary audio data, desired ancillary audio data according to the inputted ancillary audio selection data, an audio decoding unit which decodes the coded audio data to output decoded audio data, and an audio synthesis unit which synthesizes the decoded audio data and the selected ancillary audio data to output synthesis audio data. Therefore, the coding apparatus can output a stream comprising the coded audio data and the auxiliary data including the ancillary audio selection data, and the decoding apparatus can decode the inputted stream to output an audio signal comprising the audio data and the ancillary audio synthesized.

The above-described first and second embodiments can reduce the circuit scale of the decoding apparatus as compared with the third and fourth embodiments, and the third and fourth embodiment can reduce the circuit scale of the coding apparatus as compared with the first and second embodiments.

Further, in the first embodiment, not a prepared ancillary audio but an audio arbitrarily selected by the user can be multiplexed on the decoded audio, in contrast to the other embodiments.

Further, since in the second embodiment it is not necessary to encode the ancillary audio in contrast to the first embodiment, a coding circuit for the ancillary audio can be dispensed with.

Further, while in the third embodiment a decoding circuit for ancillary audio is required in contrast to the fourth embodiment, an increase in the circuit scale can be suppressed even when the number of selectable ancillary audio is increased.

Further, since in the fourth embodiment a decoding circuit for ancillary audio can be dispensed with in contrast to the third embodiment, the structure of the decoding apparatus can be simplified.

APPLICABILITY IN INDUSTRY

According to the present invention, an audio coding apparatus is constituted to output coded data of audio data and auxiliary data including data of ancillary audio to be added to the audio data, while an audio decoding apparatus is constituted to output an audio that is obtained by synthesizing the audio data and the ancillary audio by using the data of the ancillary audio included in the auxiliary data, thereby providing an audio coding apparatus and an audio decoding apparatus having high utility values.

What is claimed is:

1. An audio coding apparatus which outputs coded audio data comprising audio input that is coded, and auxiliary data that is information other than said coded audio data, according to a predetermined rule, said apparatus comprising:

a coding unit which, when it has received audio data, performs coding to the audio data and outputs the coded audio data and coding related data which is data relating to the coding for the audio data as specific data;

an ancillary audio coding unit which, when it has received an ancillary audio signal, performs coding to the ancillary audio signal to output coded ancillary audio data; and an auxiliary data output unit which produces, from the specific data and the coded ancillary audio data, auxiliary data including both of the specific data and the coded ancillary audio data to output the auxiliary data.

2. An audio decoding apparatus which decodes the coded audio data and the auxiliary data which are outputted from the audio coding apparatus as defined in claim 1, and synthesizes, from both of the decoded data, an audio signal and outputs the same, said apparatus comprising:

an ancillary audio extraction unit which extracts, from the auxiliary data, coded ancillary audio data to output the same;

an ancillary audio decoding unit which decodes the coded ancillary audio data to output decoded ancillary audio data;

an audio decoding unit which decodes the coded audio data to output decoded audio data; and an audio synthesis unit which synthesizes the audio data decoded by said audio decoding unit and the ancillary audio data decoded by said ancillary audio decoding unit to output a synthesis audio.

3. An audio coding apparatus which outputs coded audio data comprising audio input that is coded, and auxiliary data that is information other than the coded audio data, according to a predetermined rule, said apparatus comprising:

a coding unit which, when it has received audio data, performs coding to the audio data and outputs the coded audio data and coding related data which is data relating to the coding for the audio data as specific data;

an ancillary audio selecting/outputting unit which, with storing a plurality of ancillary audio data, selects one of the stored ancillary audio data according to an inputted selection signal, and outputs the selected data as coded ancillary audio data; and an auxiliary data output unit which produces, from the specific data and the coded ancillary audio data, auxiliary data including both of the specific data and the coded ancillary audio data to output the auxiliary data.

4. An audio decoding apparatus which decodes the coded audio data and the auxiliary data which are outputted from the audio coding apparatus as defined in claim 3, and synthesizes, from both of the decoded data, an audio signal and outputs the same, said apparatus comprising:

an ancillary audio extraction unit which extracts, from the auxiliary data, coded ancillary audio data to output the same;

an ancillary audio decoding unit which decodes the coded ancillary audio data to output decoded ancillary audio data;

a decoding unit which decodes the coded audio data to output decoded audio data; and an audio synthesis unit which synthesizes the audio data decoded by said audio decoding unit and the ancillary audio data decoded by said ancillary audio decoding unit to output a synthesis audio.

5. An audio coding apparatus which outputs coded audio data comprising audio input that is data, and auxiliary data that is information other than the coded audio data, according to a predetermined rule, said apparatus comprising:

a coding unit which, when it has received audio data, performs coding to the audio data and outputs the coded audio data and coding related data which is data relating to the coding for the audio signal as specific data; and an auxiliary data output unit which, when it has received ancillary audio selection signal data for selecting ancillary audio, produces, from the ancillary audio selection signal data and the specific data outputted from the audio coding unit, auxiliary data to output the same.

6. An audio decoding apparatus which decodes the coded audio data and the auxiliary data which are outputted from the audio coding apparatus as defined in claim 5, and synthesizes, from both of the decoded data, an audio signal and outputs the same, said apparatus comprising:

an ancillary audio selection data/coding related data extraction unit which extracts, from the auxiliary data, the ancillary audio selection data and the coding related data as the specific data to output both of the extracted data;

a coded ancillary audio data selecting/outputting unit which, when it has received the ancillary audio selection data, selects, from among stored 1st to Nth (N: integer not less than 2) coded ancillary audio data, desired coded ancillary audio data according to the inputted ancillary audio selection data;

an ancillary audio decoding unit which decodes the selected coded ancillary audio data to output decoded ancillary audio data;

a decoding unit which decodes the coded audio data to output decoded audio data; and an audio synthesis unit which synthesizes the decoded audio data and the decoded ancillary audio to output a synthesis audio.

7. An audio decoding apparatus which decodes the coded audio data and the auxiliary data which are outputted from the audio coding apparatus as defined in claim 5, and synthesizes, from both of the decoded data, an audio signal and outputs the same said apparatus comprising:

an ancillary audio selection data/coding related data extraction unit which extracts, from the auxiliary data, the ancillary audio selection data and the coding related data as the specific data, and outputs both of the extracted data;

an ancillary audio selecting/outputting unit which, when it has received the ancillary audio selection data, selects, from among stored 1st to Nth (N: integer not less than 2) ancillary audio data, desired ancillary audio data according to the inputted ancillary audio selection data;

a decoding unit which decodes the coded audio data to output decoded audio data; and an audio synthesis unit which synthesizes the decoded audio data and the selected ancillary audio data, and outputs a synthesis audio.

* * * * *